US006745839B1

(12) United States Patent
Simpson

(10) Patent No.: US 6,745,839 B1
(45) Date of Patent: Jun. 8, 2004

(54) BOREHOLE CLEANING APPARATUS AND METHOD

(75) Inventor: Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/070,287

(22) PCT Filed: Sep. 5, 2000

(86) PCT No.: PCT/GB00/03385

§ 371 (c)(1),
(2), (4) Date: Feb. 28, 2002

(87) PCT Pub. No.: WO01/18351

PCT Pub. Date: Mar. 15, 2001

(30) Foreign Application Priority Data

Sep. 6, 1999 (GB) ..... 9920970

(51) Int. Cl.[7] ..... E21B 37/02

(52) U.S. Cl. ..... 166/311; 166/173; 166/175; 166/177.3

(58) Field of Search ..... 166/311, 170, 166/173, 175, 176, 177.3, 153; 15/104.03, 104.061, 104.16

(56) References Cited

U.S. PATENT DOCUMENTS

| | | | | | |
|---|---|---|---|---|---|
| 864,544 | A | * | 8/1907 | Kessler et al. | 15/104.061 |
| 1,758,995 | A | * | 5/1930 | Armstrong et al. | 166/175 |
| 2,214,982 | A | * | 9/1940 | Wylie | 15/104.16 |
| 2,539,353 | A | | 1/1951 | Minyard | |
| 2,668,593 | A | | 2/1954 | Hay | |
| 3,983,938 | A | * | 10/1976 | Hellums et al. | 166/175 |
| 4,612,986 | A | * | 9/1986 | Fosdick, Jr. et al. | 166/171 |
| 4,705,107 | A | * | 11/1987 | Council et al. | 166/170 |
| 4,747,452 | A | * | 5/1988 | Clark | 166/311 |
| 5,419,397 | A | * | 5/1995 | Reynolds et al. | 166/312 |
| 6,460,616 | B1 | * | 10/2002 | Simpson | 166/104 |

FOREIGN PATENT DOCUMENTS

| | | | |
|---|---|---|---|
| FR | 2667519 | 10/1990 | B08B/9/04 |
| WO | WO 98/06927 | 2/1998 | E21B/23/14 |
| WO | WO 00/57100 | 9/2000 | F16L/55/40 |

OTHER PUBLICATIONS

International Search Report Dated Nov. 9, 2000, for Application Ser. No. PCT/GB00/03385.

* cited by examiner

*Primary Examiner*—David Bagnell
*Assistant Examiner*—Zakiya Walker
(74) *Attorney, Agent, or Firm*—Moser, Patterson & Sheridan, L.L.P.

(57) ABSTRACT

Oilfield cleaning apparatus is provided for cleaning the inner wall of an oilfield tubular. The apparatus comprises a body to be introduced into the tubular, the body being provided with annular cleaning elements. Furthermore a rotary drive acts to oscillate the cleaning elements in contact with the inner wall of the tubular to scrape debris from the inner wall with the cleaning element. Each cleaning element is mounted on a rotary bearing member which is inclined relative to its axis of rotation so as to cause the cleaning element to be oscillated axially in contact with the inner wall as the bearing member is rotated, Also a catcher tube is provided to catch the heavier debris which is not washed away by the flow of fluid up the borehole. Such apparatus provides an active cleaning action which is particularly effective in removing deposits from the inner wall of the tubular.

32 Claims, 2 Drawing Sheets

BOREHOLE CLEANING APPARATUS AND METHOD

BACKGROUND OF THE INVENTION

This invention relates to an oilfield cleaning apparatus and a method for cleaning the inner wall of an oilfield tubular. Such apparatus can be used for cleaning casing or pipeline tubulars in the petroleum industry, either downhole or when used on the surface or subsea for the transmission of oil or gas.

When running casing into a borehole in the construction of oil and gas wells, cement is commonly used to seal the casing into the hole and to seal between casings. This cement leaves scale residues in areas on the casing where it is not required, and cleaning tools must be used to remove such residues.

Furthermore oil or gas is prone to produce scale deposits, such as barium sulphate and calcium carbonate, on the inner walls of production tubing, and such scale deposits must also be removed using cleaning tools from time to time to prevent restriction of production rates.

Additionally oil produced from oil wells may in some cases carry high levels of wax which, as the oil cools, itself produces deposits along production flow lines. These deposits are also a form of scale which must be removed by use of cleaning tools if the oil transmission rate is to be maintained. In some cases, water produced with the oil carries with it minerals, such as calcium and barium, which can also be deposited in layers on the inner walls of production flow lines, together with the wax, to create laminated scales which can be very difficult to remove.

In all the above cases, it is necessary to use cleaning tools and/or chemical solvents to remove the unwanted deposits. However the mechanisms and cleaning tools used to remove the various scales encountered in the petroleum industry have not changed significantly for many years. In the case of cement scales, the mechanical scrapers or fixed brushes employed have to be moved up and down the tubular to produce the required cleaning action. An example of a prior reference disclosing such a cleaning tool is U.S. Pat. No. 4,896,720. Furthermore milling has been employed to remove the harder scales, such as barium sulphate and calcium carbonate. In addition chemical solvents have been used in isolation and together with mechanical removal systems, with varying degrees of success. In production pipelines, cleaning pigs are usually used in association with solvents, but this is an expensive exercise which needs to be repeated many times for effective cleaning.

It is an object of the invention to provide an improved technique for cleaning oilfield tubulars, such as pipe and casing sections, in such applications.

BRIEF SUMMARY OF THE INVENTION

According to the present invention there is provided oilfield cleaning apparatus for cleaning the inner wall of an oilfield tubular, the apparatus comprising a body to be introduced into the tubular, the body being provided with at least one cleaning element, and drive means acting to oscillate the cleaning element in contact with the inner wall of the tubular to scrape the inner wall with the cleaning element.

Such apparatus obviates the shortcomings of the prior art in that it provides an active cleaning action, which can be rotary, motor or turbine driven, utilising one or more oscillating cleaning elements. The cleaning elements can be grouped in modules on a common drive shaft, and the drive shaft can be used to drive an impeller which guides heavy debris not circulated out of the tubular to be drawn into a catcher element.

The invention also provides a method of cleaning an inner wall of an oilfield tubular, the method comprising introducing into the tubular a body provided with at least one cleaning element so that the cleaning element contacts the inner wall of the tubular, and operating a drive to oscillate the cleaning element to scrape the inner wall with the cleaning element.

BRIEF DESCRIPTION OF THE DRAWINGS

In order that the invention may be more fully understood, preferred embodiments of apparatus in accordance with the invention will now be described, by way of example, with reference to the accompanying drawings, in which.

DETAILED DESCRIPTION OF THE INVENTION

Figure 1:
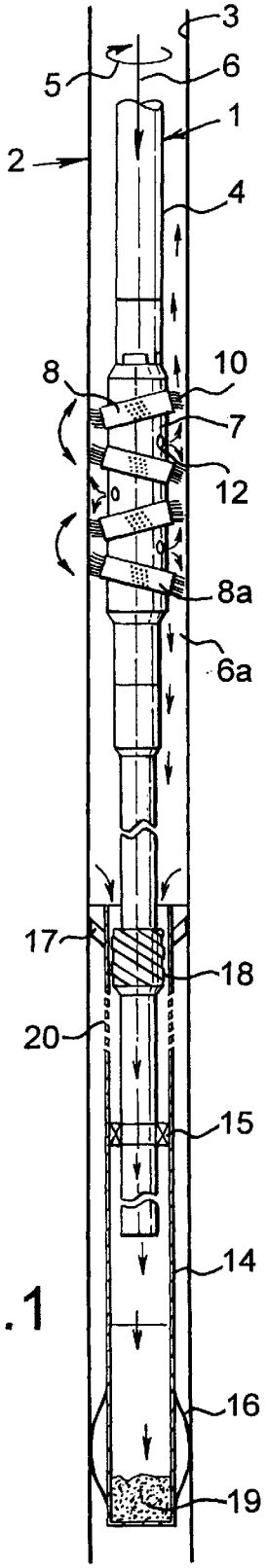
FIG. 1 is a cut-away view of a first embodiment of the invention within a borehole.

FIG. 1 shows a downhole cleaning tool 1 introduced into a casing 2 within a borehole for removing deposits from the inner wall 3 of the casing 2. The tool 1 comprises a body 4 in the form of a section of drill pipe located at the end of a pipe string to be rotated from the surface in conventional manner. At the same time as the pipe string is rotated in the direction of the arrow 5 fluid in the form of drilling mud is circulated down the pipe string in the direction of the arrow 6*a* so as to pass along an axial passage through the body 4 and back up the annular space 6*a* between the body 4 and the inner wall 3 of the casing 2.

Figure 2:
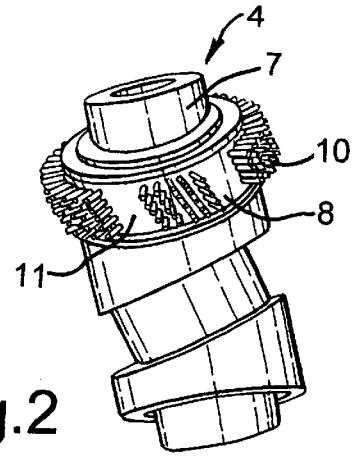
FIGS. 2 and 3 are explanatory diagrams showing details of the first embodiment.
Figure 3:
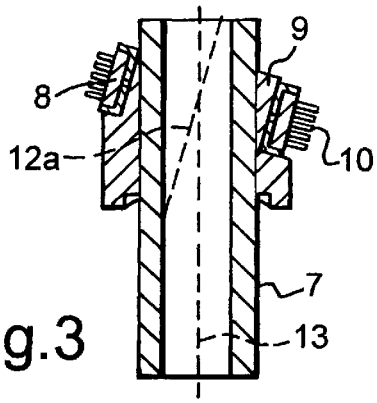

The body 4 incorporates a hollow hub 7, and four annular cleaning units 8 are mounted on the hub 7 by means of rotary bearings 9, as will be appreciated by referring to the explanatory diagrams of FIGS. 2 and 3 showing the mounting of one such cleaning unit 8 from the side and in axial section respectively. Each cleaning unit 8 is provided with cleaning elements in the form of pads of outwardly extending bristles 10 equiangularly distributed around the circumference of the unit 8. Gaps 11 are provided between the pads for flow of fluid. Each cleaning unit 8 may have an outer surface 8*a* (as shown in FIG. 1)which is curved in the axial direction to assist contact with the inner wall 3 during the cleaning action. As best seen in FIG. 3, each cleaning unit 8 is mounted by its associated bearing 9 such that its central axis 12*a* is inclined relative to the axis of rotation 13 of the bearing 9, so as to cause the bristles 10 to be oscillated axially in contact with the inner wall 3 of the casing 2 as the hub 7 is rotated. Furthermore the cleaning unit 8 may be offset axially (upwardly in FIG. 3) from the centre line of the bearing 9 so that the bristles 10 are movable towards and away from the inner wall 3 by rotation of the hub 7. Although the cleaning unit 8 is mounted on the hub 7 by the rotary bearing 9, the fact that the bristles 10 are in engagement with the inner wall 3 during cleaning means that, as the hub 7 is rotated, the bristles 10 rotate to only a limited extent with the hub 7. However the rotary movement of the hub 7 causes the bristles 10 to move inwardly and outwardly and upwardly and downwardly relative to the inner wall 3 to impart the required scraping action.

Thus, on rotation of the pipe string, the cleaning units 8 are caused to oscillate with diametrically opposite portions of the cleaning units 8 oscillating in opposite directions and corresponding portions of adjacent units 8 also oscillating in opposite directions to one another, to scour the deposits from the inner wall 3. At the same time fluid is circulated from within the body 4 through rotating jet nozzles 12 extending through the hub 7 at locations intermediate the cleaning units 8. The jets of fluid emitted by the nozzles 12 serve not only to dislodge deposits from the inner wall 3 but also to dislodge deposits attached to the bristles 10 of the cleaning units 8.

Most of the dislodged debris is circulated away in the fluid flow which travels up the annular space 6*a* between the pipe and the inner wall 3. However heavy particles, which are not circulated out of the borehole, are guided into a catcher tube 14 which is attached to the bottom of the body 4 by a rotary bearing 15 and which is prevented from rotating to any substantial extent during rotation of the pipe string by being provided with drag springs 16 which engage the inner wall 3 of the casing 2.

In order to guide the heavy debris into the catcher tube 14, rubber wiper cups 17 are provided in the annular space surrounding the top of the catcher tube 14, and a suction impeller screw 18 is provided on the body 4 within the top of the catcher tube 14, the impeller screw 18 being caused to rotate with the body 4 so as to draw fluid entraining the debris into the catcher tube 14 towards a debris containment area 19 at the bottom of the catcher tube 14. The fluid entering the catcher tube 14 is allowed to escape by way of angle ports 20 provided in the side wall of the tube 14 and arranged so that the heavy particulate matter is retained within the containment area 19 for later recovery to the surface. In a possible modification, stabiliser fins or gauge pads may be provided on the catcher tube 14 for engaging the inner wall 3 of the casing 2.

In this way the apparatus provides an effective brushing and recovery system for the cleaning and removal of scale from casing and tubing. It should be noted that the apparatus described above could also be run on coiled tubing by the inclusion of a downhole motor to provide rotational drive to the body 4. In this case circulating and jetting fluid would be provided by exhaust from the downhole motor.

Figure 5:
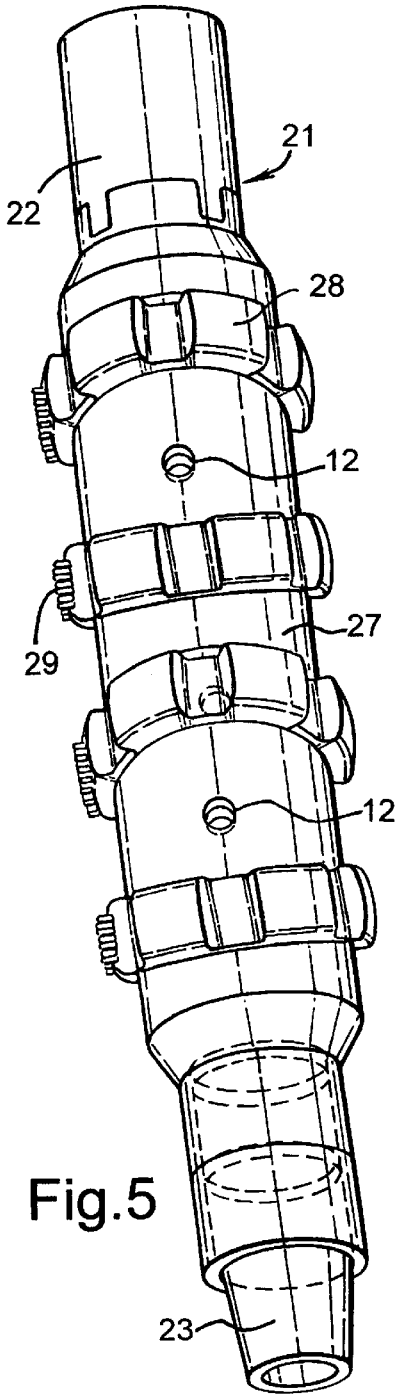
FIG. 5 is a side view of part of a second embodiment in accordance with the invention.
Figure 6:
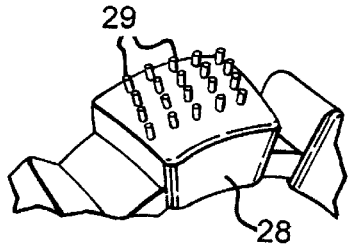
FIG. 6 is a perspective view of a detail of the second embodiment.

Various modifications of the above described apparatus may be incorporated to suit different applications. For example FIG. 5 shows a tool having a body 21 provided with a top connector 22 and a bottom connector 23 for connection to pipe sections within a pipe string to which rotary motion is imparted in a manner already described. In this case annular cleaning units 28 are mounted on a hub 27 incorporating jetting nozzles 12 in a similar manner to the cleaning units 8 already described above. However the cleaning units 28 differ from the cleaning units 8, as best seen in FIG. 6, in that they are provided with rigid metal studs 29 for engaging the inner wall of the casing while being oscillated axially in use by rotation of the body 21.

It should be appreciated that both the cleaning units 8 and the cleaning units 28 are readily detachable from the tool for replacement by new cleaning units which may be of a different type, for example of a finer or coarser brush configuration, or of the same type to the original cleaning units. Various types of cleaning unit are contemplated within the scope of the invention, and these include bristles and studs of various densities and configurations, possibly encapsulated in a rubber matrix as described in published International Application No. WO 98/06927.

Figure 7:
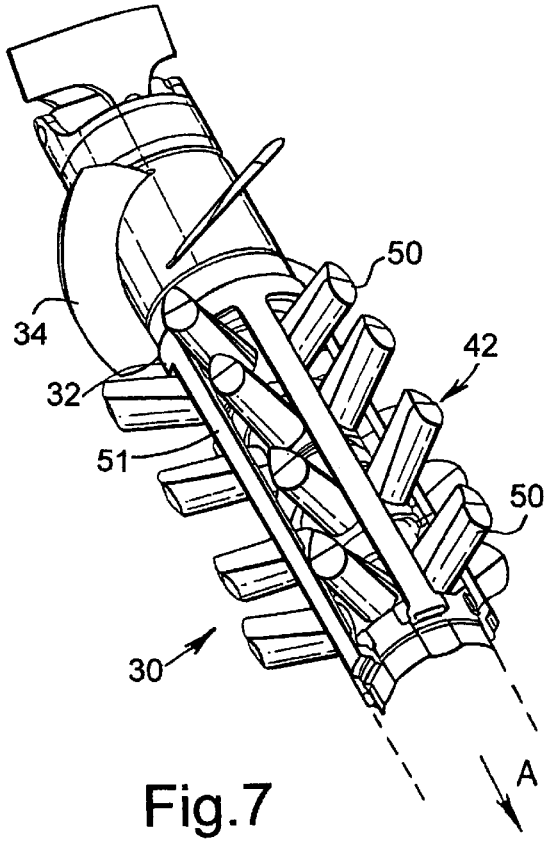
FIG. 7 is a perspective view of part of a third embodiment.

In a further embodiment the tool may incorporate one or more tractor sections 30 as shown in FIG. 7 for moving the tool along the borehole. For example cleaning units 8 or 28 as described above may be provided in modules mounted between intermediate tractor sections to provide a tool which may be moved along the borehole in a moving fluid stream obtaining its motive power from the moving fluid, the cleaning modules being provided for the removal of wax and scale in subsea pipelines, for example. Such tractor sections may be constructed generally as described in International Application No. PCT/GB00/02053, and a number of such sections may be articulated together to enable them to pass around 3D or 5D bends, drive being provided by a common articulated drive shaft which passes through the tool.

Figure 4:
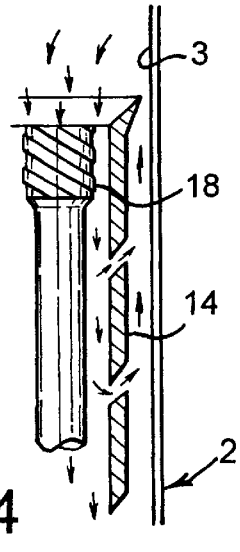
FIG. 4 shows a lower section of the first embodiment illustrating the flow paths.

FIG. 7 shows a tractor section 30 which may be used in such a tool. The tractor section 30 incorporates a housing 32 provided with a turbine 34 which is inductively coupled to a shaft within the housing 32. Furthermore a number of traction units 42 are mounted on the shaft by offset rotary bearings (not shown) in a similar manner to the mounting of the cleaning units 8 and 28 and as more particularly described with reference to FIGS. 4*b* and 4*c* of WO 98/06927. Each traction unit 42 is mounted on an annular bearing having its axis of rotation inclined relative to the shaft, and furthermore the mounting of the traction unit is offset forwardly or rearwardly relative to the centre line of the bearing.

Each traction unit 42, which is made of elastomeric material, has five outwardly extending, equiangularly distributed legs 50 which are prevented from rotating with the shaft by cage members 51. The tractor section 30 is fitted within the casing such that the legs 50 engage the inner wall of the casing so that, when the turbine 34 is rotated by moving fluid, the rotating shaft drives the legs 50 of each traction unit 42 such that each leg in turn is biased into engagement with the casing wall and, whilst in contact with the wall, is moved in the opposite direction to the intended direction A of propulsion of the tool. The resulting reaction force tends to propel the tool in the direction A, and each leg 50 is subsequently moved forwardly whilst out of contact with the casing wall, so that the combined effect of the swashing backwards and forwards motion of the legs 50 drives the tool continuously in the direction A. The direction of propulsion can be reversed by mounting the legs on the opposite side of the bearing centre line.

It might also be advantageous to mount the cleaning units 8 or 28 forwardly of the bearing centre lines so that some degree of forward bias is applied by the cleaning units to cause debris to be brushed back, as well as providing a degree of forward traction to assist in propulsion of the tool. In this type of system it is not the intention to use a catcher element for containing heavy debris, as the flow rate of fluid relative to the tool should be sufficient to carry the debris back along the flow line to the rig or platform.

What is claimed is:

1. Oilfield cleaning apparatus for cleaning the inner wall of an oilfield tubular, the apparatus comprising:

a body to be introduced into the tubular, the body being provided with at least one cleaning element on at least one annular member such that a central axis of the at least one cleaning element is inclined relative to an axis of rotation of the annular member, the body further having an axial fluid passage for the circulation of fluid to wash away debris dislodged from the inner wall by the at least one cleaning element; and a drive member acting to oscillate the at least one cleaning element in contact with the inner wall of the tubular to scrape the inner wall with the cleaning element.

2. The apparatus according to claim 1, wherein the drive member acts to rotate the at least one cleaning element during such oscllation.

3. The apparatus according to claim 1, wherein the annular member is a rotary bearing member such that rotation of the bearing member causes the at least one cleaning element to be oscillated axially in contact with the inner wall as the bearing member is rotated.

4. The apparatus according to claim 3, wherein the at least one cleaning element is mounted on the bearing member such that the at least one cleaning element is offset from a centre line of the bearing member so that the at least one cleaning element is biased towards and away from the inner wall as the bearing member is rotated.

5. The apparatus according to claim 1, wherein the body is provided with a plurality of cleaning elements disposed in an annular configuration.

6. The apparatus according to claim 5, wherein the cleaning elements are separated by gaps for fluid flow.

7. The apparatus according to claim 5, wherein the cleaning elements are provided on a plurality of annular members, which are spaced apart axially along the body.

8. The apparatus according to claim 1, wherein the at least one cleaning element comprises outwardly projecting bristles or studs.

9. The apparatus according to claim 1, wherein the at least one cleaning element has an outer surface which is curved in the axial direction to assist contact with the inner wall during oscillation of the cleaning element.

10. The apparatus according to claim 1, wherein the at least one cleaning element is urged against the inner wall by the drive member such that the at least one cleaning element is movable relatively freely in contact with the inner wall in one axial direction, but substantially less freely in contact with the inner wall in the opposite axial direction to provide the required scraping action.

11. The apparatus according to claim 1, wherein a catcher element is mounted on the body for catching heavy debris dislodged from the inner wall by the at least one cleaning element.

12. The apparatus according to claim 1, wherein the body comprises a length of pipe which is rotatable by the drive member in order to oscillate the at least one cleaning element.

13. The apparatus according to claim 1, wherein an impeller member is mounted on the body and is drivable by the drive member in order to direct heavy debris dislodged from the inner wall by the at least one cleaning element to a required containment area.

14. The apparatus according to claim 1, wherein at least one jetting nozzle is provided on the body in the vicinity of the at least one cleaning element to wash away debris dislodged from the inner wall by the at least one cleaning element.

15. The apparatus according to claim 1, wherein the drive means is adapted to impart drive to the at least one cleaning element within a borehole from the surface by means of a pipe string extending along the borehole.

16. The apparatus according to claim 1, wherein the drive means incorporates a downhole motor for imparting drive to the at least one cleaning element within a borehole.

17. The apparatus according to claim 1, wherein the drive member comprises a fluid-driven member mounted on the body for imparting drive to the at least one cleaning element within a borehole.

18. The apparatus according to claim 17, wherein the fluid-driven member is a turbine blade.

19. The apparatus according to claim 17, wherein the drive member incorporates at least one traction element for engaging the inner wall to impart a propulsion force for moving the body along the tubular when driven by the fluid-driven member.

20. The apparatus according to claim 19, wherein the drive member is adapted to urge at least a part of the at least one traction element outwardly against the inner wall whilst said part is moved relative to the body in the opposite direction to the direction in which the body is to be propelled.

21. The apparatus according to claim 19, wherein the at least one traction element has a plurality of outwardly extending legs substantially equiangularly distributed about a central axis, the drive member acting to bias each of the legs in turn against the inner wall in operation.

22. The apparatus according to claim 19, wherein the at least one traction element is mounted on a rotary bearing member which is inclined relative to its axis of rotation so as to cause the at least one traction element to be moved alternately in opposite directions as the bearing member is rotated.

23. The apparatus according to claim 1, wherein a plurality of cleaning elements and traction elements are mounted on the body with at least one of the traction elements being positioned between two adjacent cleaning elements.

24. The apparatus according to claim 1, comprising a plurality of cleaning modules articulated together to allow them to pass around bends, each cleaning module incorporating at least one cleaning element.

25. A method of cleaning the inner wall of an oilfield tubular, the method comprising:

introducing into the tubular a body provided with at least one cleaning element on at least one annular member such that a central axis of the at least one cleaning element is inclined relative to an axis of rotation of the annular member so that the at least one cleaning element contacts the inner wall of the tubular;

operating a drive to oscillate the at least one cleaning element to scrape the inner wall with the at least one cleaning element; and pumping fluid through an axial fluid pathway formed in the body to wash away debris dislodged from the inner wall.

26. An apparatus for cleaning the inner wall of an oilfield tubular, comprising:

a body to be introduced into the tubular, the body being provided with at least one cleaning element;

drive means acting to oscillate the cleaning element in contact with the inner wall of the tubular to scrape the inner wall with the cleaning element; and a catcher element mounted on the body for catching heavy debris dislodged from the inner wall by the at least one cleaning element.

27. The apparatus according to claim 26, wherein the catcher element is mounted on the body in such a way that the catcher element does not rotate in operation to any substantial extent.

28. The apparatus of claim 26 further comprising an impeller member mounted on the body and drivable by the drive means in order to direct heavy debris dislodged from the inner wall by the at least one cleaning element to the catcher element.

29. An apparatus for cleaning the inner wall of an oiltield tubular, comprising:

a body to be introduced into the tubular, the body being provided with at least one cleaning element; and drive means acting to oscillate the cleaning element in contact with the inner wall of the tubular to scrape the inner wall with the cleaning element, wherein the drive means comprises a fluid-driven member mounted on the body for imparting drive to the at least one cleaning element within a borehole, and wherein the fluid-driven member is a turbine blade.

30. An apparatus for cleaning the inner wall of an oilfield tubular, comprising:

a body to be introduced into the tubular, the body being provided with at least one cleaning element;

drive member acting to oscillate the cleaning element in contact with the inner wall of the tubular to scrape the inner wall with the cleaning element; and at least one traction element having a plurality of outwardly extending legs for engaging the inner wall to impart a propulsion force for moving the body along the tubular when driven by a fluid-driven member.

31. An oilfield cleaning apparatus for cleaning the inner wall of an olifield tubular, the apparatus comprising:

a body to be introduced into the tubular, the body being provided with at least one cleaning element on at least one rotary bearing member such that a central axis of the at least one cleaning element is inclined relative to an axis of rotation of the rotary bearing member, wherein the rotation of the rotary bearing member causes the at least one cleaning element to be oscillated axially in contact with the inner wall as the rotary bearing member is rotated; and a drive member acting to oscillate the at least one cleaning element in contact with the inner wall of the tubular to scrape the inner wall with the cleaning element.

32. The apparatus according to claim 31, wherein the at least one cleaning element is mounted on the bearing member such that the at least one cleaning element is offset from a centre line of the bearing member so that the at least one cleaning element is biased towards and away from the inner wall as the bearing member is rotated.

* * * * *